United States Patent [19]

Dranger

[11] Patent Number: 4,555,136

[45] Date of Patent: Nov. 26, 1985

[54] FURNITURE CONSTRUCTION

[76] Inventor: Jan Dranger, 7, Carl Milles väg, S-181 34 Lidingö, Sweden

[21] Appl. No.: 480,435

[22] Filed: Mar. 30, 1983

[51] Int. Cl.[4] ..... A47C 7/36; A47C 7/50

[52] U.S. Cl. ..... 297/108; 16/302; 297/114; 297/306; 297/396

[58] Field of Search ..... 297/108, 114, 396, 285, 297/300, 296, 306, 378, 353; 5/57 D, 57 E; 16/283, 302, 321

[56] References Cited

U.S. PATENT DOCUMENTS

| | | | |
|---|---|---|---|
| 44,987 | 11/1864 | Staples | 297/296 X |
| 162,447 | 4/1875 | Wilson | 297/108 X |
| 248,919 | 11/1881 | Crosgrave | 297/114 |
| 323,137 | 7/1885 | Franzen | 297/296 X |
| 1,821,136 | 9/1931 | Bolakowski | 16/302 |
| 2,702,074 | 2/1955 | Vincent, Jr. | 297/396 X |
| 2,812,802 | 11/1957 | Gieglow | 297/396 |
| 4,420,186 | 12/1983 | Vogt | 297/114 X |

FOREIGN PATENT DOCUMENTS

| | | | |
|---|---|---|---|
| 1079143 | 4/1902 | France | 297/108 |
| 631884 | 12/1927 | France | 297/108 |
| 860938 | 1/1941 | France | 297/306 |
| 266055 | of 1950 | Switzerland | 297/108 |
| 847192 | 9/1960 | United Kingdom | 297/396 |

*Primary Examiner*—William E. Lyddane
*Assistant Examiner*—Peter R. Brown
*Attorney, Agent, or Firm*—Pollock, VandeSande and Priddy

[57] ABSTRACT

In a furniture article consisting of a back rest, seat and foot rest the foot rest is pivotally moveable between a position in which the foot rest is held substantially horizontally outwardly from the seat, and a position in which the foot rest abuts against the seat. This is achieved by a frame work holding the seat support material, which frame work consists entirely of side edge rods having hinges between the seat and the foot rest portion of the side rods, the frame work having no transverse rods which could decrease the physiologically acceptable seat functions and comfort of the article in any of said foot rest positions. The back rest portions of the side rods are provided with hinges which permit the back rest to assume two positions, one with a high back rest and the other with a low back rest having a portion of the back rest abutting against the remaining back rest surface, without any comfort decreasing transverse rods existing in either of said back rest positions.

8 Claims, 6 Drawing Figures

FURNITURE CONSTRUCTION

The present invention relates to a furniture construction consisting of side members and cross bars positioned between the side members, a seat frame work consisting of rods and fixed to the side members, and foldable seat material in one piece arranged between side rods of the seat frame work forming support surfaces for the user.

Furniture constructions in the form of sun chairs are previously known which are foldable from a substantially horizontal position to a sitting position having seat and back rest. Like the present invention these known constructions include a frame work consisting of rods for holding the support surface material, and longitudinal edge rods in the frame work are located between the foot rest and seat and articulated for swinging the foot rest from a horizontal position to a position of abutment against the seat in the seat position of the sun chair. The edge rods of the foot rest are either provided with a support leg at the free end edge of the foot rest, for instance as shown in the French Pat. No. 1 079 143, or provided with at least one transverse rod between the edge rods, for instance as shown in the French Pat. No. 1 251 133. Both of these arrangements will jam against the body of the person sitting in the chair in its seat position and this gives rise to a medical, physiological problem that has been the subject of many studies and investigations. These studies have found that the prior arrangements sometimes cause a shutting off of the blood supply of a person sitting in the chair and also temporary or permanent injuries, particularly on the back. These known furniture constructions accordingly do not meet the demand made upon the primary function of a seat chair, namely to be able to sit in the chair without the occurrence of physiologically unsuitable or injurious pressure points on vital body parts.

The present invention provides a furniture construction which provides a comfortable and a physiologically correct design thereof, which is comparatively simple in construction and cheap to manufacture, and which nevertheless also provides an esthetically attractive appearance for use indoors. Moreover, variations as to form of the furniture construction have in a simple way and without extra fittings been made possible. In addition to this, there are the advantages that the furniture construction can be stored and delivered in comparatively small packages containing a folded frame work consisting of the rods and the support surface material as a unit and the gables suited for the rods, and that the furniture construction can easily be mounted in situ.

The invention will be described in more detail with reference to the following drawings.

FIGS. 3*a–d* is a perspective view showing one embodiment of a frame work with upholstering in four different positions.

FIGS. 4*a–d* show another embodiment of the frame work with upholstering in four positions corresponding to the positions in FIGS. 3*a–d*.

Figure 1:
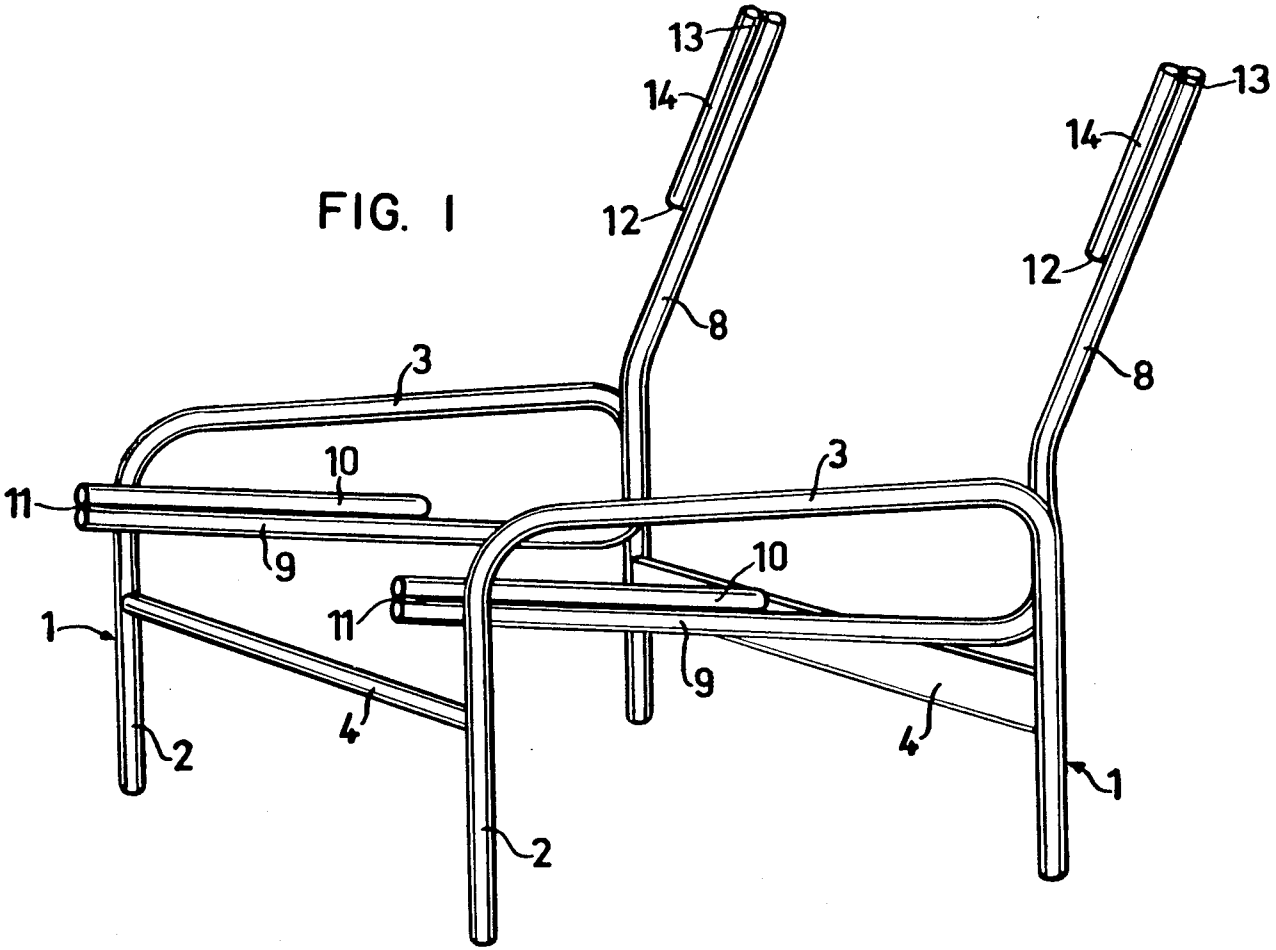
FIG. 1 is a perspective view showing a furniture construction according to the invention but without upholstering.
Figure 4A:
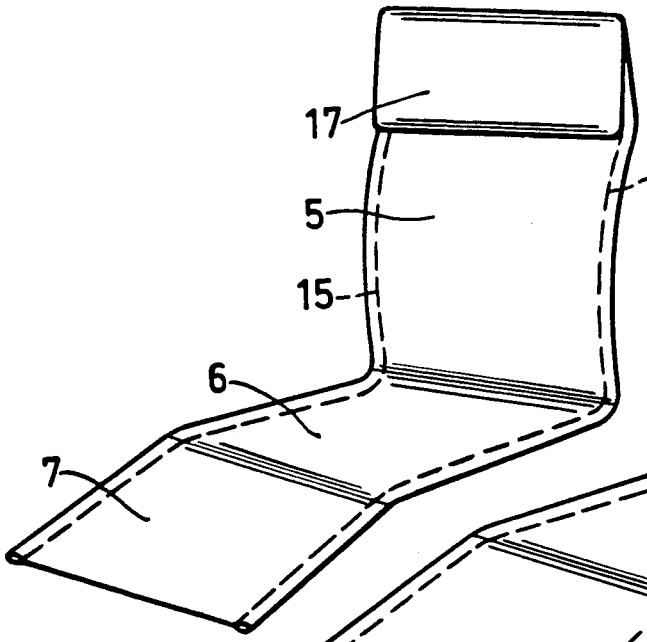
Figure 4B:
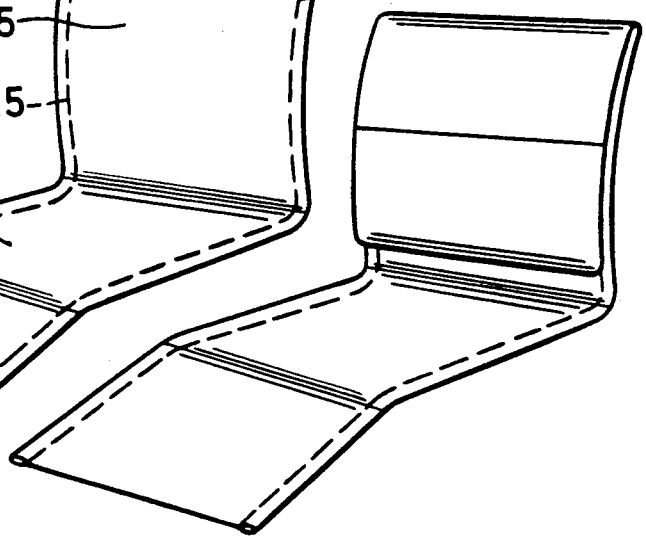
Figure 4C:
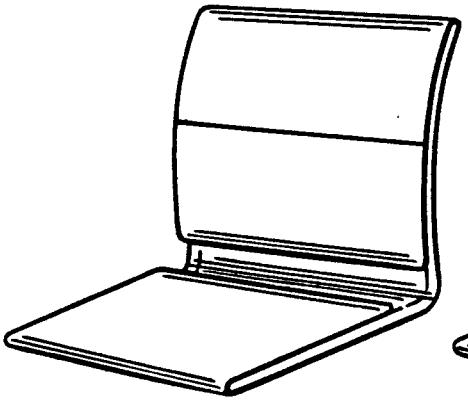
Figure 4D:
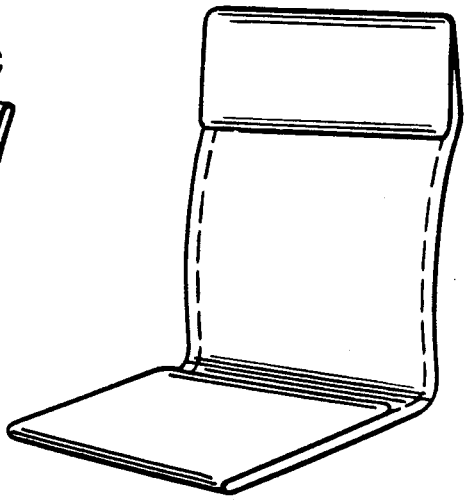
Figure 5:
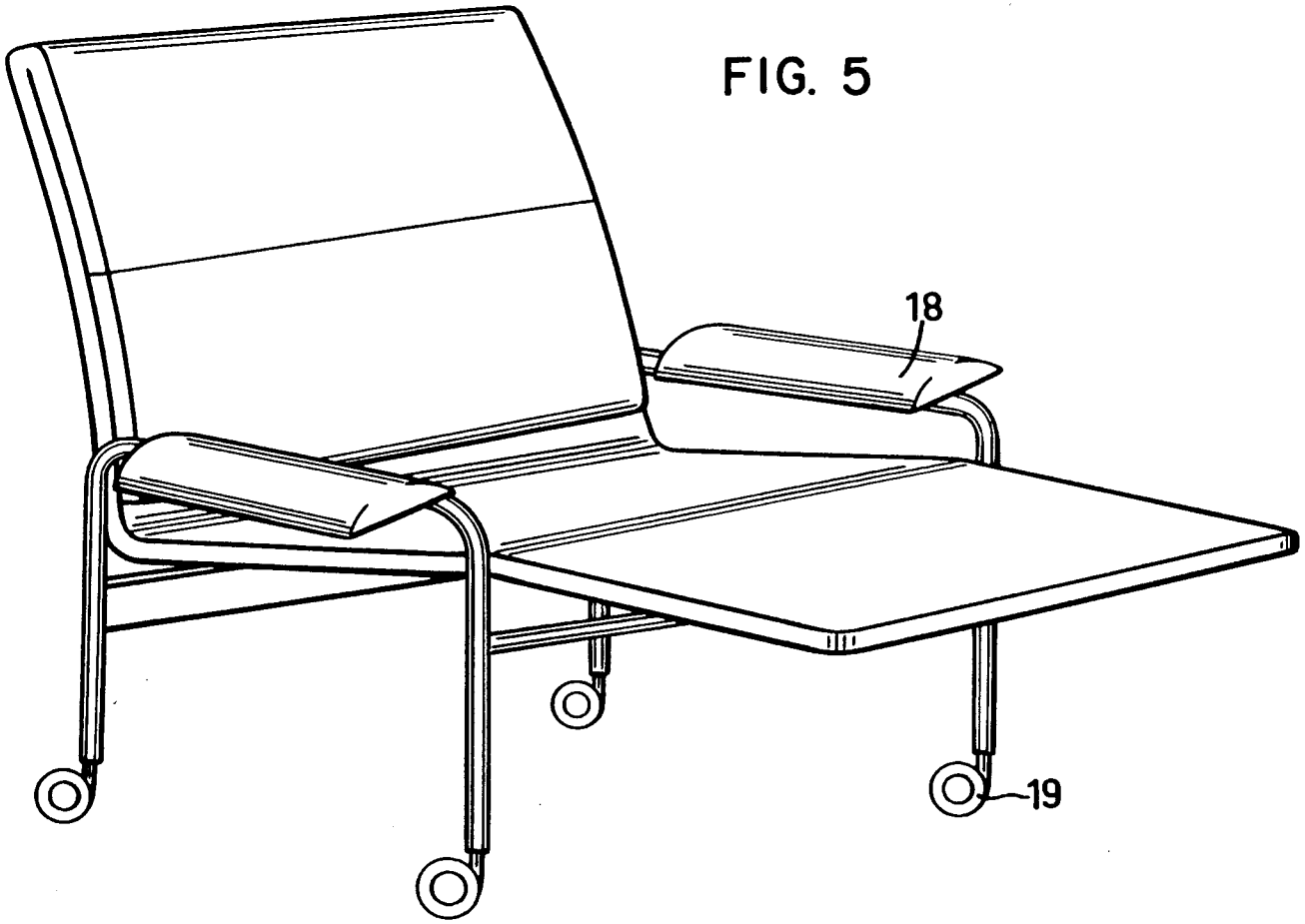

FIG. 5 is a perspective view showing a furniture construction according to FIG. 1 with upholstering and in the position shown in FIG. 4*b*.

Figure 6:
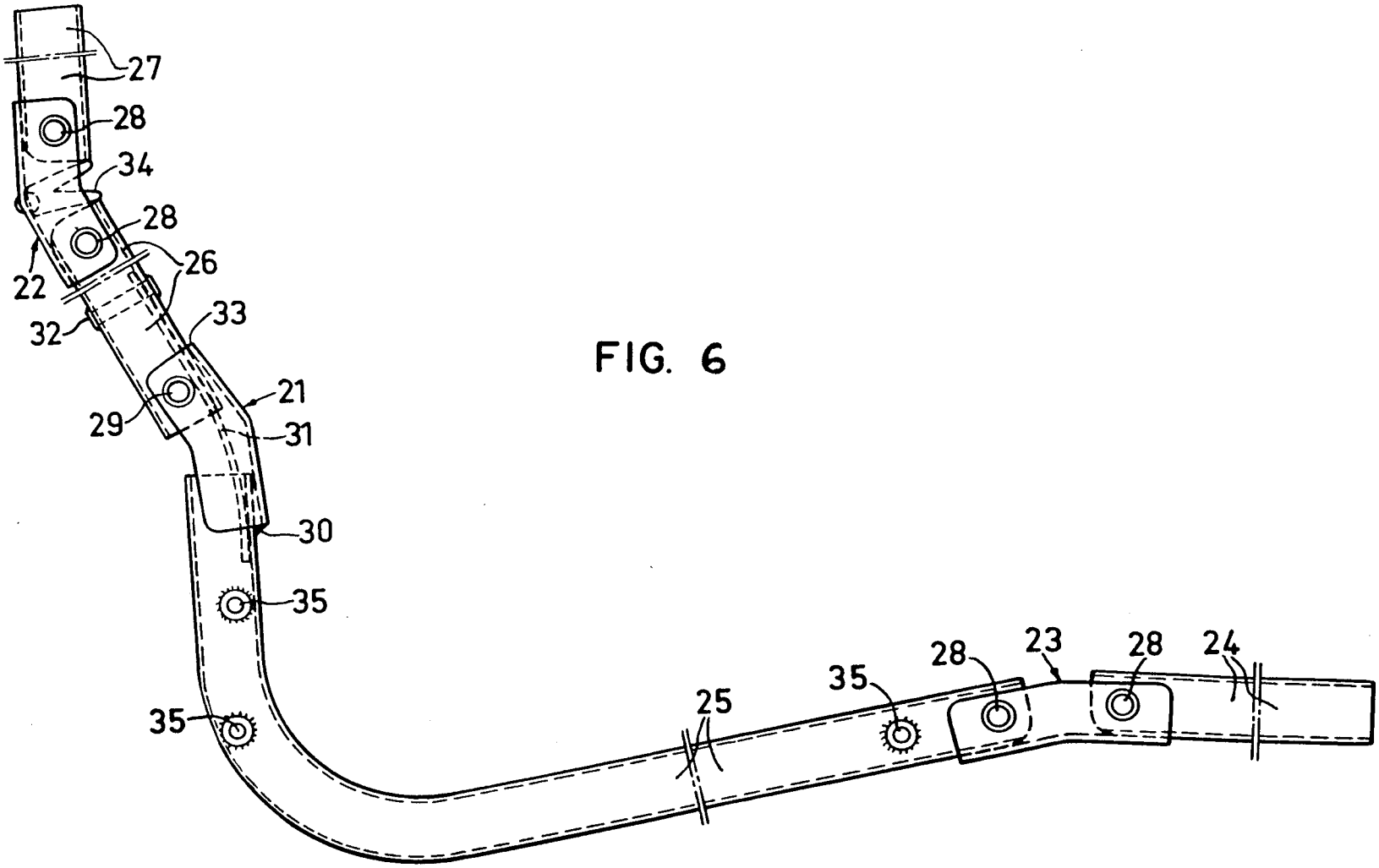

FIG. 6 is a side view showing another edge rod forming a part of the frame work of the furniture construction.

The furniture construction shown in FIG. 1 has side members, commonly designated with 1, consisting of rods, hollow or solid, bent to U-shape with the shanks forming chair legs 2 and the web arm 3 of the chair. The side members are interconnected by cross rods 4 fixed to the legs 2. A frame work forming back rest 5, seat 6 and foot rest 7 (see FIGS. 3–5) is located above the mounting points of the cross rods 4 and fixed to the inner side of the legs 2.

Figure 2:
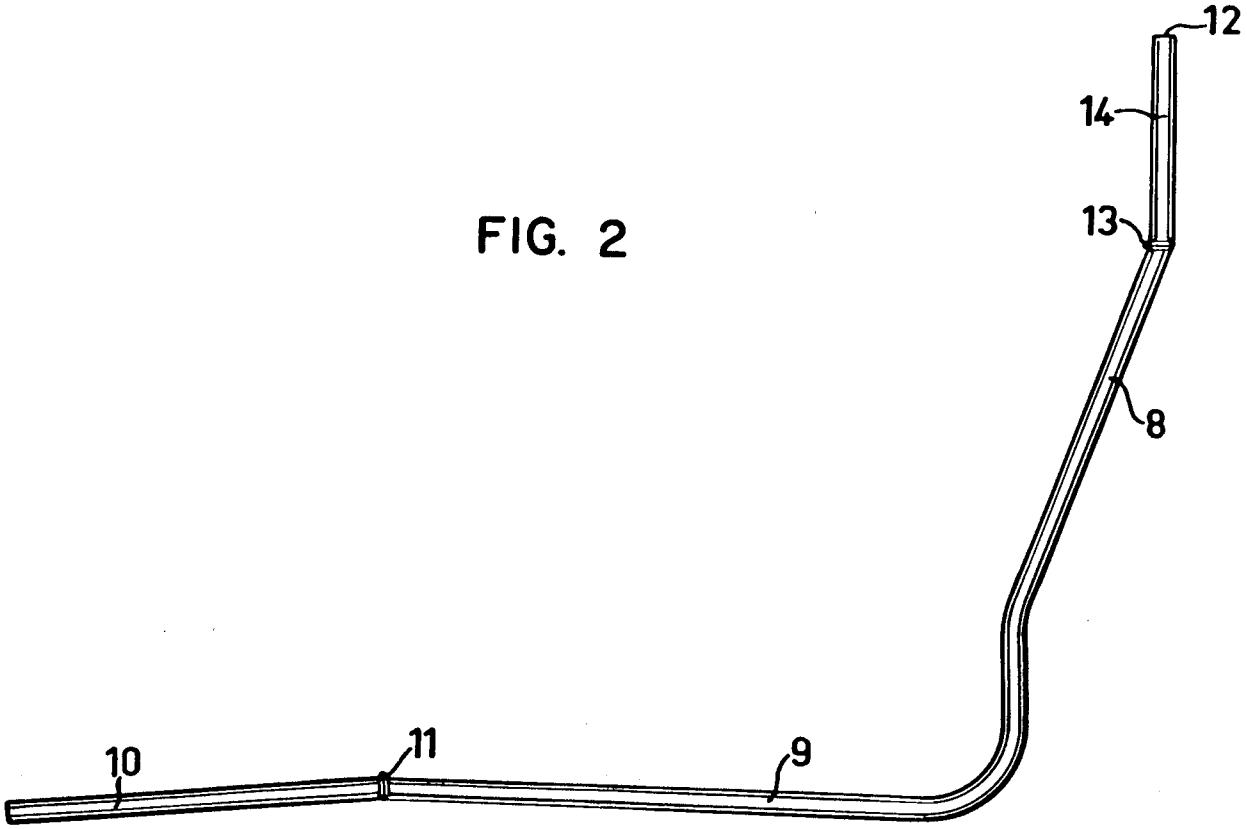
FIG. 2 is a side view showing an edge rod forming a part of the frame work of the furniture construction.
Figure 3A:
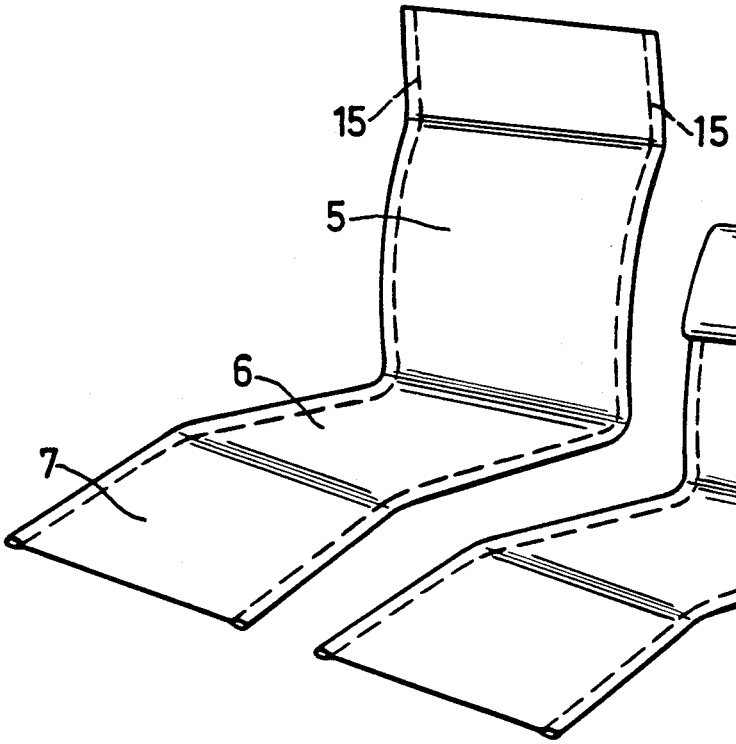
Figure 3B:
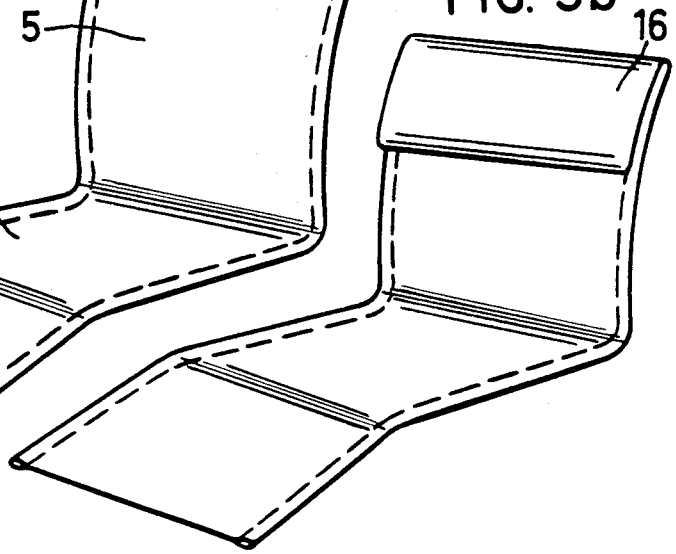
Figure 3C:
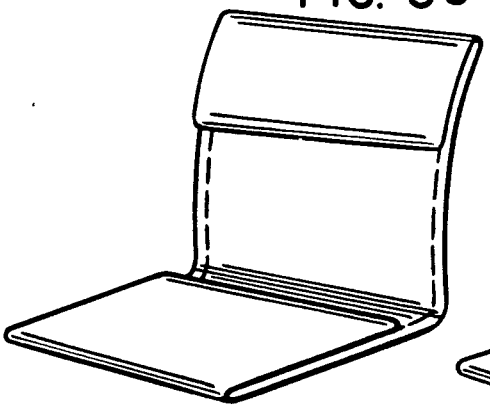
Figure 3D:
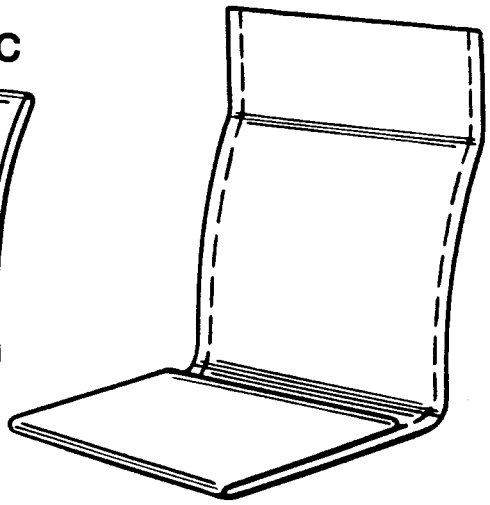

The frame work only consists of edge rods or side rods 8, 9, 10 arranged along the side edges of the back rest, the seat and the foot rest, respetively. An edge or side rod 8, 9, 10 is shown in FIG. 2. A hinge 11 is positioned between the edge rods 9 of the seat 6 and the edge rods 10 of the foot rest 7, and these hinges allow swinging of the edge rods 10 relatively to the edge rods 9 between the position shown in FIG. 1 with the edge rods 10 lying against the edge rods 9 and the position shown in FIG. 2 (see also FIG. 5), in which the edge rods 10 are held substantially horizontally outwardly from the edge rods 9. Moreover, the edge rods 8 of the back rest 5 are provided at a fitted distance from the free ends 12 provided, with a hinge 13 for arranging the edge rod part 14 so that it may be positioned between hinge 13 and free end 12 either as shown in FIG. 1 or as shown in FIG. 2.

As is schematically illustrated in FIGS. 3 and 4, the furniture upholstering is formed in one piece different portion of which provide back rest 5, seat 6 and foot rest 7, and is provided with seams 15 along its opposing edges which form pockets for the edge rods 8, 9, 10 and 14. By using a frame work having edge rods as shown in FIGS. 1 and 2, four different forms of the furniture have been made possible. FIG. 3*a* illustrates a form with the foot rest 7 swung outwardly and high back rest 5. FIG. 3*b* illustrates another form with the foot rest swung outwardly and a low back rest, achieved by swinging the edge rod parts 14 downwardly so that the furniture upholstering portion 16 between the edge rods parts 14 can serve as an extra support for the back or neck. Still another form is illustrated in FIG. 3*c* (see also FIG. 1), in which the foot rest 7 has been swung up into abutment against the seat 6. FIG. 3*d* illustrates a fourth form with a high back rest 5 as in FIG. 3*a* and foot rest 7 swung up as in FIG. 3*d*. FIGS. 4*a–d* illustrate different forms corresponding to those in FIGS. 3*a–d*. The embodiment shown in FIG. 4 differs from the embodiment according to FIG. 3 only in that the upholstering extends beyond the free ends 12 of the edge rod part 14 and hangs, in the high position of the back rest 5 shown in FIG. 4*a* and 4*d*, down in front of the back rest as a cushion 17. In the position for the edge rod parts 14 as illustrated in FIGS. 4*b* and 4*c* (see also FIG. 5) the cushion 17 and the upholstering between the edge rod parts cover substantially the whole back rest and thus form a twice as thick back rest.

It should be noted that in all positions illustrated in FIGS. 3 and 4 there is no transverse rod or other cross member that can abut against the body of the user and cause discomfort. On the contrary, the demands made upon comfort and physiologically correct form of a furniture article are met, and at the same time the construction is simple, cheap, and allows the variation possibilities illustrated in FIGS. 3 and 4.

In addition to what has been described above, FIG. 5 shows that the furniture article can be provided with arm cushions 18 and chair leg rollers 19.

FIG. 6 shows another embodiment of an edge or side rod which differs from that shown in FIGS. 1–2. In this alternative arrangement, the edge rods are provided with a further hinge 21 besides the hinges, here designated with the reference numerals 22 and 23, which are arranged to provide the above described swinging motion of the foot rest and the upper part of the back rest, respectively. This further hinge 21 is arranged to make the back rest resilient backwards so as to achieve still greater comfort for the person sitting in the furniture construction.

The edge rod shown in FIG. 6 also differs from the edge rod shown in FIG. 2 in consisting of hollow square rod parts 24, 25 and 26, 27 for the foot rest, seat and back rest, respectively. The hinges 21–23 are particularly formed for adaptation to the edge rod parts and consist of elongated channel members having a U-shaped cross section. The channels are adaptably angle-formed in order to provide a suitable angle between the edge rod parts thereby to produce a suitable form of the furniture construction. The hinges are fixed to the adjacent edge rod parts in order to allow the above mentioned swinging movements and the U-formed hinges also provide appropriate support surfaces for the edge rod parts. Thus, pivot pins 28 are fixed to respective edge rod parts 26, 27 and 24, 25, respectively, for the pivotal movements about the hinges 22 and 23, respectively. To achieve the resilient pivotal movement of the edge rod part 26, the hinge 21 is attached to edge rod part 26 by means of pivot pin 29 and welded at 30 to the edge rod part 25 of the seat, and a leaf spring 31 is positioned in the hinge 21. The spring 31, is attached at one end thereof to the edge rod part 26 by means of a rivet 32 and its opposite end abuts against the inner side of the edge rod part 25. The spring is held prestressed over the pivot pin 29 so that when the edge rod 26 is in its maximum raised position it is held pressed against the edge 33 of the web of the U-formed hinge. By this arrangement, the edge rod 26 can pivot backwards against the action of the spring 31 until the portion of the edge rod part 26 below the edge 33 abuts the web portion of the hinge.

As shown in FIG. 6, the hinge 22 is also provided with a spring 34, which is formed and arranged to firmly hold the upper edge rod part 27 of the back rest in its raised position but to allow its pivotal movement to the position abutting the edge rod part 26.

Finally, FIG. 6 shows riveted screw bushings 35 at the edge rod part 25 of the seat, which bushings are used to fasten the edge rod to the side members 1 of the furniture construction (see FIG. 1).

The invention is not limited to the embodiments described above and shown on the drawings but can be varied in different ways within the scope of the following claims. Thus, the edge rods can be formed differently even through the form shown in FIG. 6 is preferred. The edge rods can be fastened to the side members of a sofa.

I claim:

1. An article of furniture comprising a pair of vertical side members disposed in horizontally spaced relation to one another and interconnected to one another by a plurality of horizontal cross bars to form a stable ground engaging frame of fixed configuration, a pair of elongated side rods connected respectively to said pair of side members, said side rods being supported entirely by said frame in spaced relation to all of said cross bars and being free of any cross bars extending therebetween, each of said side rods including a generally horizontal seat rod portion which is connected to said frame, one end of said seat rod portion extending forwardly of said frame and being attached to a foot rest rod portion of said side rod, and the other end of said seat rod portion being smoothly curved upwardly to a generally vertically extending back rest rod portion, and an elongated unitary sheet of foldable support material connected along its opposing elongated edges to each of said rod portions of said pair of side rods respectively, said side rods forming together with said sheet of support material a generally horizontally extending seat, a foot rest at the front edge of said seat, and a back rest extending upwardly in a generally vertical direction from said smoothly curved rod portion adjacent the rear edge of said seat, said foot rest rod portion and seat rod portion of each of said side rods being separate rod portions which are interconnected to one another by a hinge adjacent said front edge of said seat, said hinges on said pair of side rods being operative to hold and support said foot rest in a first generally horizontal position wherein said foot rest extends away from said seat and outwardly of said ground engaging frame in freely spaced relation to the ground, said hinges also being operative to permit said foot rest to be pivoted to a second generally horizontal position wherein said foot rest overlies said seat, said ground engaging frame comprising the sole support of said article of furniture in all positions of said foot rest, all portions of said sheet of foldable material being held by said side rods above and in spaced relation to all of said horizontal cross bars at all times and in all positions of said foot rest, seat and back rest, and both opposing ends of each of said side rods being free ends which are freely spaced from the corresponding free ends of the other of said side rods and from both of said side members and all of said cross bars, said sheet of support material being free of engagement with any cross bar throughout the entire extent of said sheet between the opposing ends of said side rods, and the body of a user of said furniture article being free of engagement with any cross bar and in engagement with only said sheet of support material in all positions of said foot rest, seat and back rest.

2. The furniture article of claim 1 wherein each of said side rods includes a pair of separate back rest rod portions which are interconnected to one another by a further hinge that is located in spaced relation to the rear edge of said seat, whereby said back rest comprises an outer back rest portion that can be pivoted about said further hinges into abutment with the portion of said back rest below said further hinges.

3. The furniture article of claim 1 or 2 wherein each of said side rods comprises a hollow tube having a square cross section, each of said hinges comprising an elongated channel member which has a U-shaped cross section and which overlies the two rod portions with which said hinge is associated.

4. The furniture article of claim 2 including spring means located between said pair of separate back rest rod portions and operative to normally hold said outer back rest portion in a generally vertical raised position but to allow said pivotal motion of said outer back rest portion to said abutting position.

5. The furniture article of claim 1 wherein each of said side rods includes a pair of back rest rod portions which are spaced from one another adjacent the rear edge of said seat, and spring means located between said pair of back seat rod portions operative to permit said back rest rod portions to resiliently move relative to one another thereby to permit said back rest to be flexed resiliently relative to said seat.

6. The furniture article of claim 1 wherein said side rods are disposed within elongated pockets that are formed along the elongated edges of said sheet of support material.

7. An article of furniture comprising a pair of vertical side members disposed in horizontally spaced relation to one another and interconnected to one another by a plurality of horizontal cross bars, a pair of elongated side rods connected respectively to said pair of side members, and an elongated unitary sheet of foldable support material connected along its opposing elongated edges to said pair of side rods respectively, each of said side rods being shaped in its direction of elongation to form together with said sheet of support material a generally horizontally extending seat, a foot rest at the front edge of said seat, and a back rest extending in a generally vertical direction from the rear edge of said seat, each of said side rods including separate rod portions for said foot rest and seat and a hinge adjacent said front edge of said seat which interconnects said foot rest and seat rod portions to one another and which is operative to hold said foot rest in a first generally horizontal position wherein said foot rest extends away from said seat and operative to permit said foot rest to be pivoted to a second generally horizontal position wherein said foot rest overlies said seat, all portions of said sheet of foldable material being held by said side rods above and in spaced relation to all of said horizontal cross bars at all times and in all positions of said foot rest, seat and back rest, and the opposing ends of each of said side rods being free ends which are freely spaced from the corresponding free ends of the other of said side rods and from said side members and cross bars, whereby said sheet of support material is free of engagement with any cross member throughout the entire extent of said sheet between the opposing ends of said side rods, and whereby the body of a user of said furniture article is free of engagement with any cross member and abuts only said sheet of support material in both said first and second positions of said foot rest and in all positions of said seat and back rest, each of said side rods including a pair of back rest rod portions which are spaced from one another adjacent the rear edge of said seat, a channel shaped hinge member overlying said spaced back rest rod portions, said hinge member being fixedly attached to one of said back rest rod portions and being pivotally attached to the other of said back rest rod portions by a pivot pin which extends between the sides of and substantially parallel to the base of said channel shaped member, and spring means located between said back rest rod portions operative to permit said back rest rod portions to move resiliently relative to one another thereby to permit said back rest to be flexed relative to said seat, said spring means being operative to normally hold said other back rest rod portion in engagement with an edge of the base of said channel shaped member at one side of said pivot pin and with the free end of said other back rest rod portion on the other side of said pivot pin being spaced from said base, and said spring means being further operative to permit said other back rest rod portion to pivot about said pivot pin against the force of said spring means until said free end of said other back rest rod portion engages the base of said channel shaped member.

8. The furniture article of claim 7 wherein said spring means comprises an elongated leaf spring one end of which is slideably disposed adjacent said one of said spaced rod portions and the other end of which is fixedly attached to said other of said spaced rod portions.

* * * * *